US009393455B2

(12) United States Patent
Salamon et al.

(10) Patent No.: US 9,393,455 B2
(45) Date of Patent: Jul. 19, 2016

(54) BED EXERCISE DEVICE

(71) Applicants: Samuel M. Salamon, Beachwood, OH (US); Yosef M. Salamon, Beachwood, OH (US); Vladimir Feldman, Cleveland, OH (US)

(72) Inventors: Samuel M. Salamon, Beachwood, OH (US); Yosef M. Salamon, Beachwood, OH (US); Vladimir Feldman, Cleveland, OH (US)

(73) Assignee: Stuck in Bed Fitness Solutions, LLC, Beachwood, OH (US)

( * ) Notice: Subject to any disclaimer, the term of this patent is extended or adjusted under 35 U.S.C. 154(b) by 94 days.

(21) Appl. No.: 14/107,434

(22) Filed: Dec. 16, 2013

(65) Prior Publication Data

US 2015/0165256 A1 Jun. 18, 2015

(51) Int. Cl.

| | |
|---|---|
| ***A63B 21/02*** | (2006.01) |
| ***A63B 21/04*** | (2006.01) |
| ***A61H 1/00*** | (2006.01) |
| ***A47D 7/04*** | (2006.01) |
| ***A63B 71/00*** | (2006.01) |

(Continued)

(52) U.S. Cl.

CPC ..... *A63B 21/0442* (2013.01); *A63B 21/0555* (2013.01); *A63B 21/0557* (2013.01); *A63B 21/1672* (2015.10); *A63B 21/4029* (2015.10); *A63B 21/4035* (2015.10); *A63B 21/4043* (2015.10); *A63B 23/0211* (2013.01); *A63B 23/03541* (2013.01); *A63B 23/1218* (2013.01); *A63B 23/1263* (2013.01); *A63B 23/1281* (2013.01); *A63B 71/0009* (2013.01); *A63B 2023/006* (2013.01); *A63B 2071/0018* (2013.01); *A63B 2208/0228* (2013.01); *A63B 2208/0252* (2013.01); *A63B 2210/50* (2013.01); *A63B 2225/093* (2013.01)

(58) Field of Classification Search

CPC .. A63B 21/04; A63B 21/055; A63B 21/0552; A63B 21/16; A63B 21/1672; A63B 23/12; A63B 23/1245; A63B 23/1263; A63B 23/1272; A63B 2208/0242; A63B 2208/0257; A63B 2210/04; A63B 2208/0252; A63B 23/1281; A63B 21/0442; A63B 21/1681; A63B 71/0009; A61H 2201/0119; A61H 2201/0142

USPC ..... 601/23, 24, 84, 86, 90, 98; 602/32; 5/662, 658, 503.1

See application file for complete search history.

(56) References Cited

U.S. PATENT DOCUMENTS 247,403 A * 9/1881 Pistorius ..... 5/646
781,328 A * 1/1905 Brown ..... A61G 7/005 108/49

(Continued)

FOREIGN PATENT DOCUMENTS

EP 0514368 A1 5/1992

*Primary Examiner* — Oren Ginsberg
*Assistant Examiner* — Nyca T Nguyen
(74) *Attorney, Agent, or Firm* — Rankin, Hill & Clark LLP

(57) ABSTRACT

A bed exercise device adapted to be mounted to a bed includes a rail with a plurality of openings there through by which exercise components can be mounted. First and second legs extend from opposite ends of the rail. The first and second legs attach at a first end of each of the first and second legs to the opposite ends of the rail and at a second end of each of the first and second legs to first and second brackets, respectively. The first and second brackets are adapted to attach to a frame of the bed. According to an alternative embodiment, a triangular frame is attached to the lower portion of the first and second legs to support an assembly of a rail, first and second arching portions, and first and second legs.

5 Claims, 7 Drawing Sheets

(51) Int. Cl.

| | |
|---|---|
| ***A63B 21/055*** | (2006.01) |
| ***A63B 23/02*** | (2006.01) |
| ***A63B 23/035*** | (2006.01) |
| ***A63B 23/12*** | (2006.01) |
| *A63B 23/00* | (2006.01) |

(56) References Cited

U.S. PATENT DOCUMENTS

| | | | | |
|---|---|---|---|---|
| 798,114 | A * | 8/1905 | Rosenthal | 482/130 |
| 1,436,367 | A * | 11/1922 | Sullivan | A63H 33/006 446/227 |
| 3,310,817 | A * | 3/1967 | Harding | 5/662 |
| 3,978,610 | A * | 9/1976 | Stubbmann | 446/227 |
| 4,925,184 | A | 5/1990 | McJunkin, Jr. et al. | |
| 5,013,035 | A * | 5/1991 | Nathaniel | 482/129 |
| 5,207,628 | A | 5/1993 | Graham | |
| 5,820,532 | A | 10/1998 | Oliver | |
| 6,241,642 | B1 | 6/2001 | Slenker | |
| 6,416,447 | B1 * | 7/2002 | Harmon | 482/129 |
| 7,618,355 | B1 | 11/2009 | Murdock | |
| 2004/0176227 | A1 * | 9/2004 | Endelman | 482/142 |
| 2007/0203434 | A1 | 8/2007 | Namgung et al. | |
| 2009/0077751 | A1 * | 3/2009 | Jacobson et al. | 5/640 |
| 2009/0098987 | A1 * | 4/2009 | McBride et al. | 482/133 |
| 2009/0215594 | A1 * | 8/2009 | Panaiotov | 482/130 |
| 2011/0166005 | A1 | 7/2011 | Cicco | |
| 2013/0074270 | A1 | 3/2013 | Caruso et al. | |

* cited by examiner

BED EXERCISE DEVICE

FIELD OF THE INVENTION

The present invention relates to bed exercise device adapted to be mounted to a bed and more particularly to a bed exercise device including an assembly of a rail, legs, and brackets adapted to be mounted to the frame of a bed.

BACKGROUND OF THE INVENTION

Exercise devices are provided in a variety of sizes, styles, and means of providing exercise for an individual. The most useful exercise devices provide some means of resistance against which exercises are performed. Resistance is provided in a variety of ways, with a personal exercise device preferably providing lightweight resistance, as opposed to heavy weights or other mechanisms of heavy resistance. Most exercise machines require that the exerciser stand up when using the device, lie down on the device, or sit thereupon. Thus, most exercise devices are built with the assumption that the exerciser is already able-bodied and merely desires to enhance his or her physical abilities.

Recent medical advances have allowed more patients to survive serious injuries or disease processes than ever before. Unfortunately, the period of bed rest required for recovery often leads to severe deterioration of muscle strength and a corresponding inability of the patient to support full body weight upon standing. People confined to hospital beds for extended periods of time have limited possibilities for routine activities such as exercising, using a computer, writing, and reading. In several stages of their recovery period, many people are able and even need to exercise their body, but have no tools or assistance from others for such activities. Further, they may be unable to leave their bed to perform exercise on traditional exercise machines.

SUMMARY OF THE INVENTION

According to an embodiment of the present invention, there is disclosed a bed exercise device adapted to be mounted to a bed. The bed exercise device includes a rail with a plurality of openings through which exercise components can be mounted. First and second legs extend from opposite ends of the rail. The first and second legs attach at a first end of each of the first and second legs to the opposite ends of the rail and at a second end of each of the first and second legs to first and second brackets, respectively. The first and second brackets are adapted to attach to a frame of the bed.

According to another embodiment of the present invention, there is disclosed a bed exercise device adapted to be mounted to a bed. The bed exercise device includes a rail having first and second arching portions mounted on opposite ends of the rail. The first and second arching portions have a plurality of openings through which exercise components can be mounted. The first and second legs are mounted to the first and second arching portions, respectively. The first and second legs are adapted to be connected to a frame of the bed.

According to still another embodiment of the present invention, there is disclosed a bed exercise device adapted to be mounted to a bed. The bed exercise device includes a rail having first and second arching portions mounted on opposite ends of the rail. The first and second arching portions having a plurality of openings through which exercise components can be mounted. The first and second legs are mounted to the first and second arching portions, respectively. A triangular frame attached to the lower portion of the first and second legs to support an assembly of the rail, the first and second arching portions, and the first and second legs.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

FIG. **8*a*** is a front three dimensional view of a bracket for mounting the bed exercise device to a bed frame, in accordance with the present invention.

Figure 9:
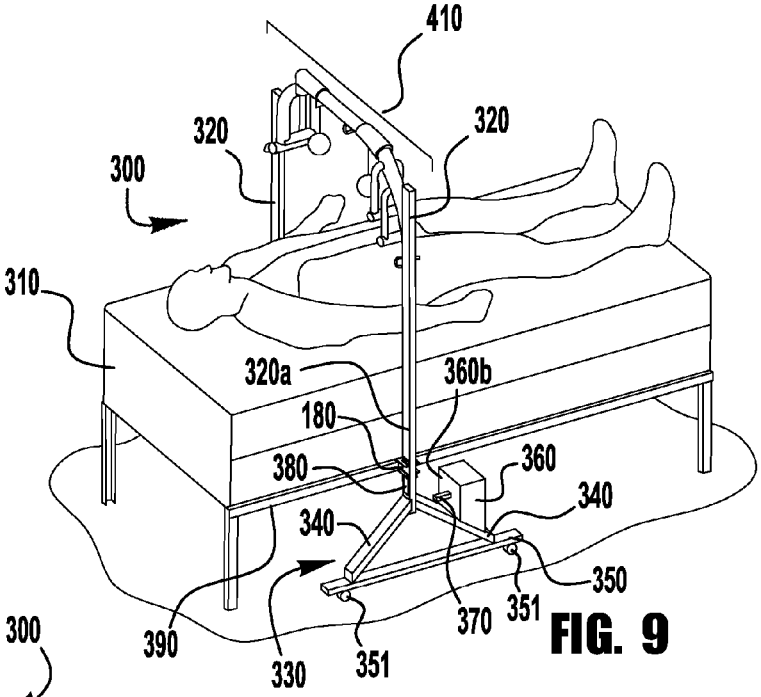

FIG. 9 is a front three dimensional view of an alternative embodiment of the bed exercise device with a novel mounting system disengaged on a traditional bed, in accordance with the present invention.

Figure 10:
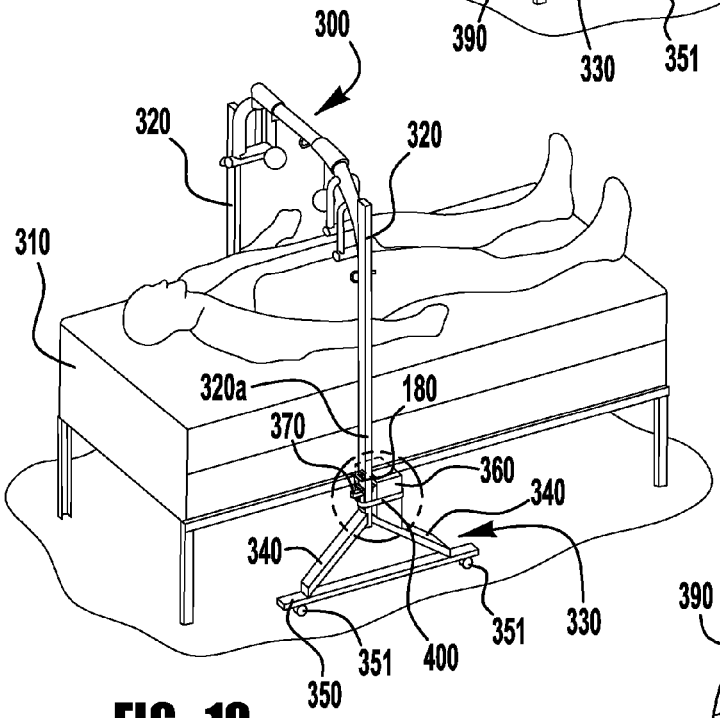

FIG. 10 is a front three dimensional view of an alternative embodiment of the bed exercise device with a novel mounting system engaged on a traditional bed, in accordance with the present invention.

FIG. **10*a*** is a front three dimensional close view of the novel mounting system engaged on a traditional bed, in accordance with the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Wellknown processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Figure 1:
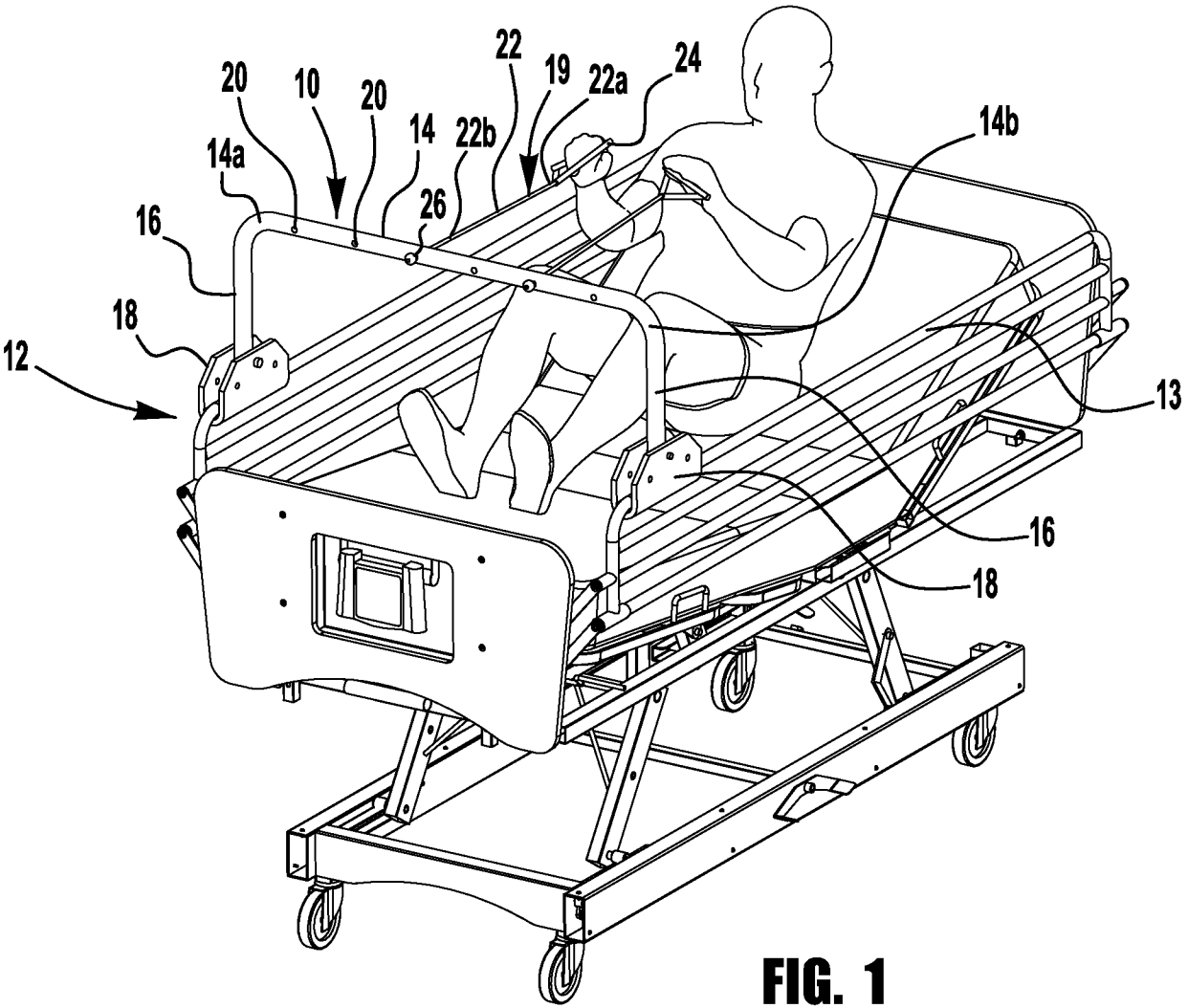
FIG. 1 is a front three dimensional view of an embodiment of the bed exercise device in use on a bed, in accordance with the present invention.

Exercise and strengthening of muscles is very important to the maintenance of health. Many people who are sick and bedridden or generally more sedentary lose muscle tone, which leads into a cycle of further loss of muscle strength. Even people who are not bedridden or sedentary often require regular exercise therapy to strengthen muscles to address ongoing maladies such as back pain. Sometimes it is necessary for people to perform exercises first thing in the morning right after waking up and even before getting out of bed to allow them to become mobile. Accordingly, people confined to beds are generally excluded from enjoying the benefits of conventional exercise equipment. The bed exercise device 10, as shown in FIG. 1, is designed to provide a multifunctional and portable fitness device specifically for those who are confined to a bed, although anyone may use this device. While the bed exercise device 10 is described in relationship to a bed, it can also be used with wheelchairs, sofas, benches, and various types of chairs and seats.

Figure 2:
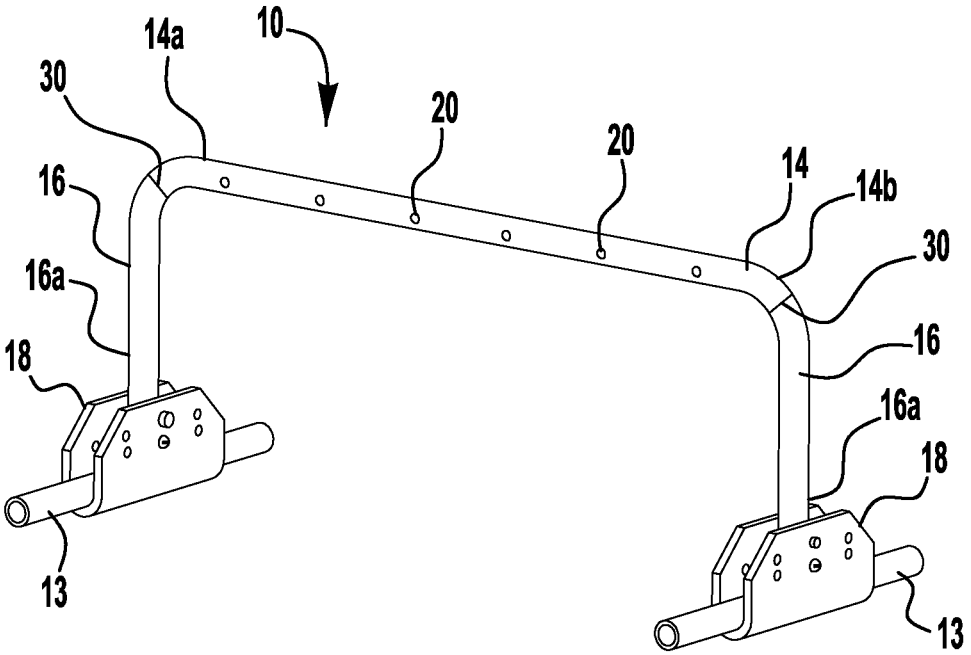
FIG. 2 is a front three dimensional view of an embodiment of the bed exercise device, in accordance with the present invention.

FIG. 1 illustrates a front three-dimensional view of the bed exercise device 10, in use with a bed 12. In general terms, bed exercise device 10 consists of a rail 14 with a plurality of openings 20 for mounting exercise components 19, designed to attach to the bed 12. As seen in FIGS. 1 and 2, first and second legs 16 extend from opposite ends 14*a* and 14*b* of the rail 14. Preferably, first and second legs 16 extend approximately 90° from opposite ends 14*a* and 14*b* of the rail 14. Each leg 16 is designed to be attached to first and second brackets 18 disposed at ends 16*a*. Brackets 18 are utilized to attach to the frame 13 of the bed 12. Brackets 18 are designed to be easily removed from the frame 13, to allow for easy disassembly and portability. The user may simply lay in the bed, and achieve fitness while recovering. Exercises with the bed exercise device 10 may be performed from different positions, e.g., squatting, sitting, kneeling, and lying. The bed exercise device 10 may be used to exercise the whole body, e.g. upper, mid, and lower body parts including the arms, back, abdominals, and legs, to provide a total body workout. The bed exercise device 10 is simple to use and is universally capable of use by anyone.

Figure 3:
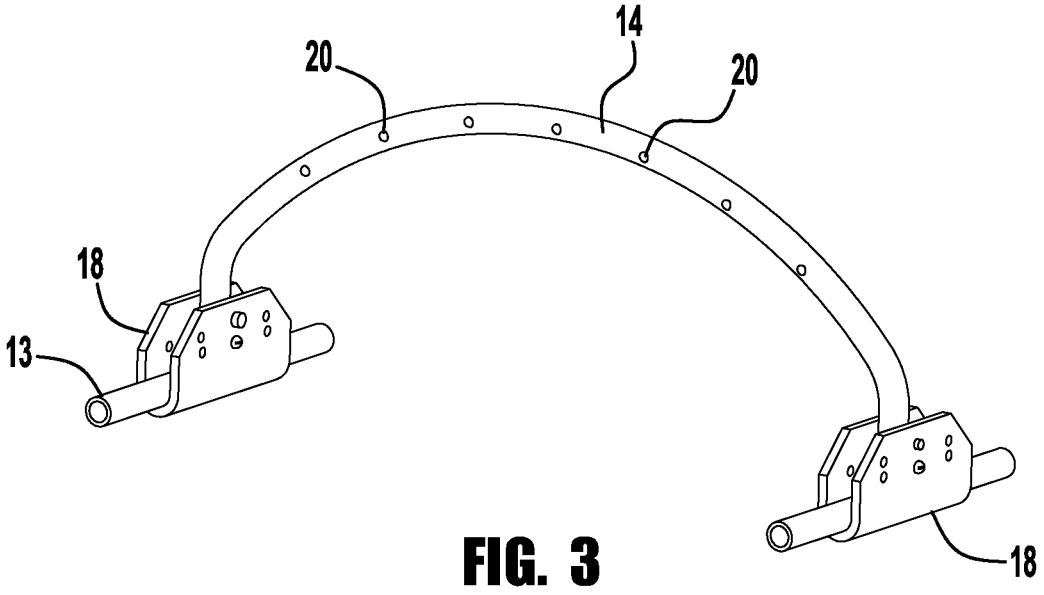
FIG. 3 is a front three dimensional view of an alternative embodiment of the bed exercise device, in accordance with the present invention.

FIG. 2 illustrates a detailed view of the bed exercise device 10. The bed exercise device 10 may be constructed of any appropriate material, such as a plastic or lightweight metal. Further, bed exercise device 10 may have any desired shape, such as the alternative shape as illustrated in FIG. 3 wherein the rail 14 has a bowed out shape. The bed exercise device 10 is designed to fit a standard hospital bed, although any desired sized bed with a suitable frame may be utilized. The dimensions of the bed exercise device 10 may include a length with a range of between 2 feet and 8 feet and a height with a range between 1 feet and 6 feet. Further, it is within the term of the preferred embodiment that the size of the bed exercise device 10 be adjustable. For example, the legs 16 may be telescoping (not shown).

There is a plurality of openings 20 within the rail 14, through which the exercise components 19, such as resistance bands, are temporarily secured. There may be any number of openings 20. Each opening has a diameter with a range between 0.125 inches and 1 inch. It is within the terms of the preferred embodiment that there be hinges 30 on ends 14*a* and 14*b* of the rail 14, respectively. Hinges 30 allow the legs 16 to fold, thereby making the bed exercise device 10 more compact and portable. When the bed exercise device 10 is ready for use, the hinges 30 may be locked into place and the device may be attached to the bed 12.

There is a plurality of openings 20 within the rail 14, through which resistance bands 19 are to be secured. The resistance bands 19 stretch and elongate under pressure, to provide the necessary resistance to a user when conducting exercises. The resistance bands 19 are designed to be hand held and may be closed loop or open elastic resistance cords. Resistance bands 19 provide an advantage over traditional exercise equipment through ease of use in that they are lightweight, compact, and inexpensive. Additionally, resistance bands 19 provide increasing resistance as they stretch through a range of motion. The bed exercise device 10 is designed to accommodate any of the known type of exercise component 19 such as resistance bands manufactured and marketed by number of companies, such as Spri™, Power Systems™, Perform Better™, and Thera-Band™. It is also within the terms of the embodiments that the resistance bands 19 specifically engineered for the bed exercise device 10 are provided. Typically, traditional resistance bands 19 consists of a fixed length cord 22, with at least one handle 24 attached at the first end 22*a* of the cord.

Figure 4:
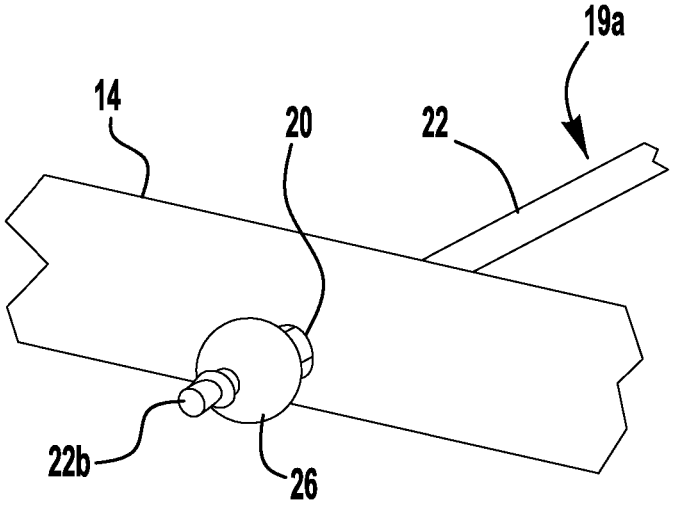
FIG. 4 is a front three dimensional view of specifically engineered resistance band mounted to the rail of the bed exercise device, in accordance with the present invention.

Exercise components 19 are temporarily secured to the bed exercise device 10 when in use. As illustrated in FIG. 4, the specifically engineered resistance bands 19*a* incorporate a detachable anchor 26 at a second end 22*b* of the cord 22, which temporarily secures the resistance band 19 within the opening 20 while the resistance band is in use. When the user wishes to remove the resistance band 19*a* from the opening 20, he may simply remove the anchor 26 and remove the resistance band.

Figure 5:
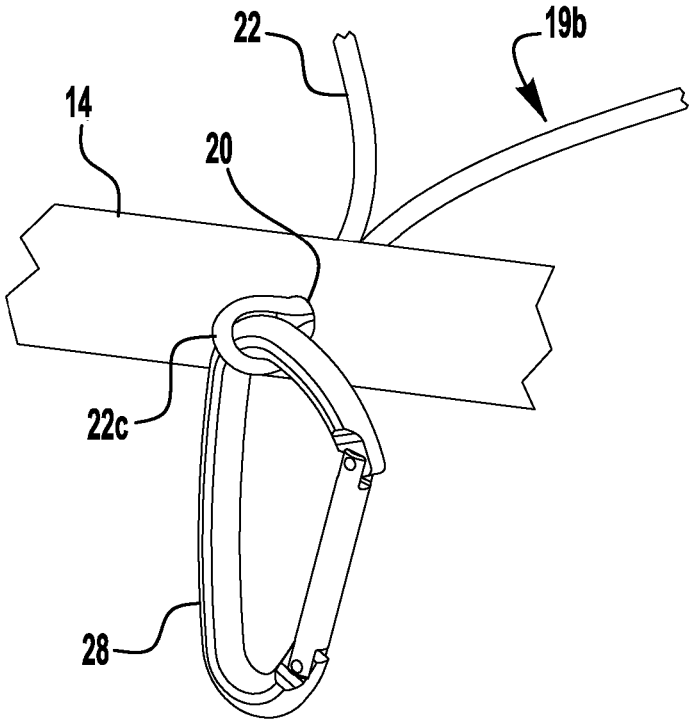
FIG. 5 is a front three dimensional view of a traditional resistance band mounted to the rail of the bed exercise device, in accordance with the present invention.

FIG. 5 illustrates a traditional resistance band 19*b*, in which there are two handles (not shown) attached to the cord 22. In this situation, the user may simply thread a central portion 22*c* through the opening 20 within the rail 14. A clip 28, such as a carabiner, may be secured to the central portion 22*c* that extends through the opening 20. Then, the resistance band 19 is held in place within the opening 20. Upon finishing the desired exercise, the clip 28 may simply be removed from the central portion 22*c* of the cord 22, allowing the resistance band 19*b* to be removed from the bed exercise device 10.

There may be a variety of resistance bands 19 with differing strengths and may allow varying ranges of motion. Regardless of whether a specifically engineered resistance band 19*a* or traditional resistance band 19*b* is utilized, each may be easily moved from the openings 20 to permit the user to adjust the level of resistance quickly and easily over a greater range and allows for greater ease and speed of adjustment of resistance when conducting exercises.

Figure 6:
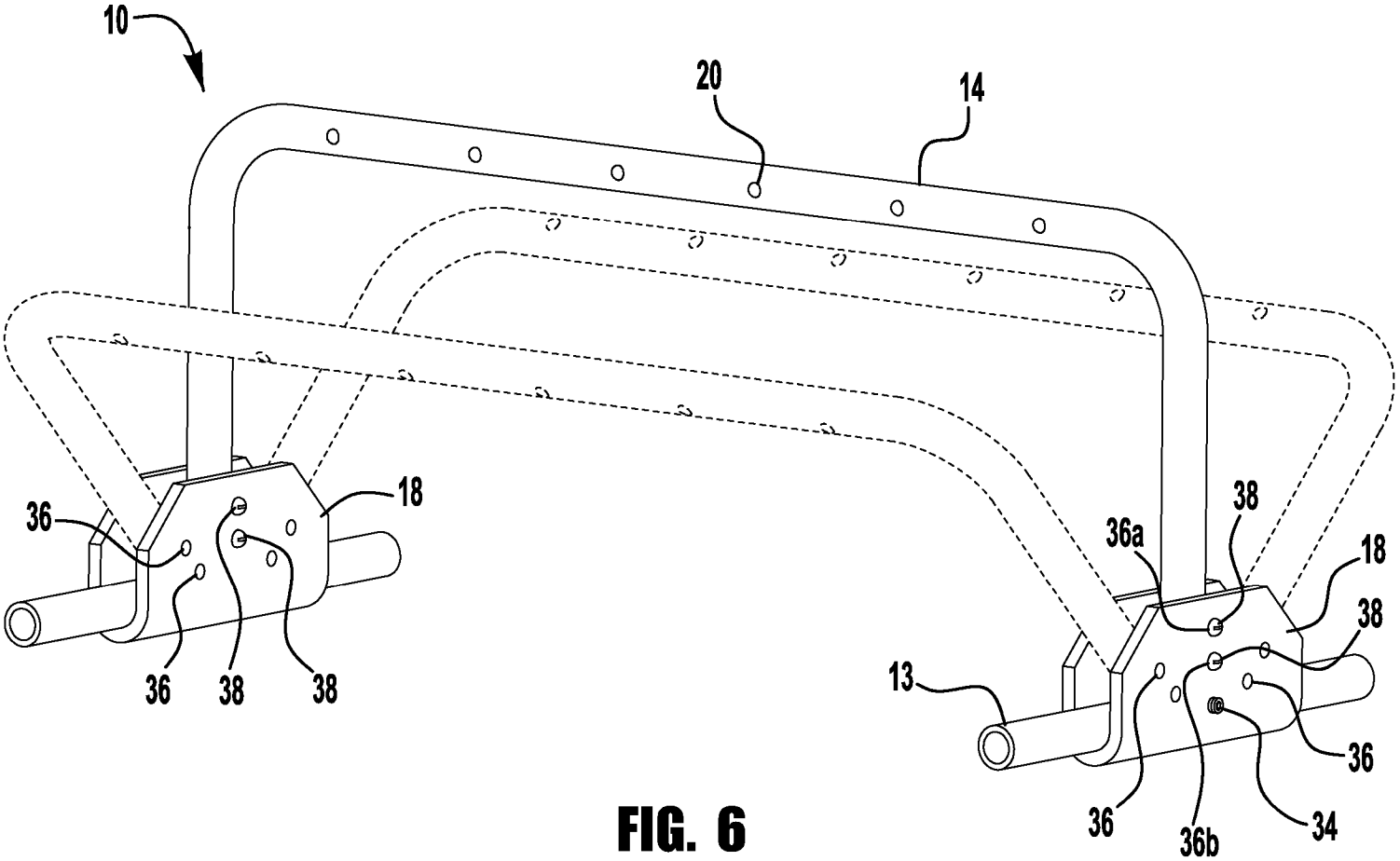
FIG. 6 is a front three dimensional view of the various positions of the rail and of the bracket system of the bed exercise device, in accordance with the present invention.

FIG. 6 illustrates a detailed view of the brackets 18 that secure the bed exercise device 10 to the frame 13. Each bracket 18 may be temporarily mounted to the frame 13 in any desired manner, such as with a set screw 34. Set screw 34 extends through an opening through each bracket 18, and tightened so as to hold the bracket in place on the frame 13.

Once each bracket 18 has been secured to the frame 13, the bed exercise device 10 may be attached to the brackets 18. There are a series of parallel openings 36 in each of the brackets 18, allowing for various potential settings of the rail 14 of the bed exercise device 10. The rail 14 may be adjustable so as to allow for different settings and angles for the user. Once the user picks a desired angle, bolts 38 are placed in an upper and lower opening 36*a* and 36*b*, and through corresponding openings (not shown) in the ends of the legs 16 of the bed exercise device 10 and affixed thereto with nuts. The nuts and bolts 38 secure the bed exercise device 10 to the bracket 18.

It is also within the terms of the embodiment that the exercise device 10 be used in combination with a wheelchair. In this scenario, the exercise device 10 may attach to the arms of the wheelchair (not shown), allowing the user to perform exercise with the resistance bands while seated in the wheelchair.

Figure 7:
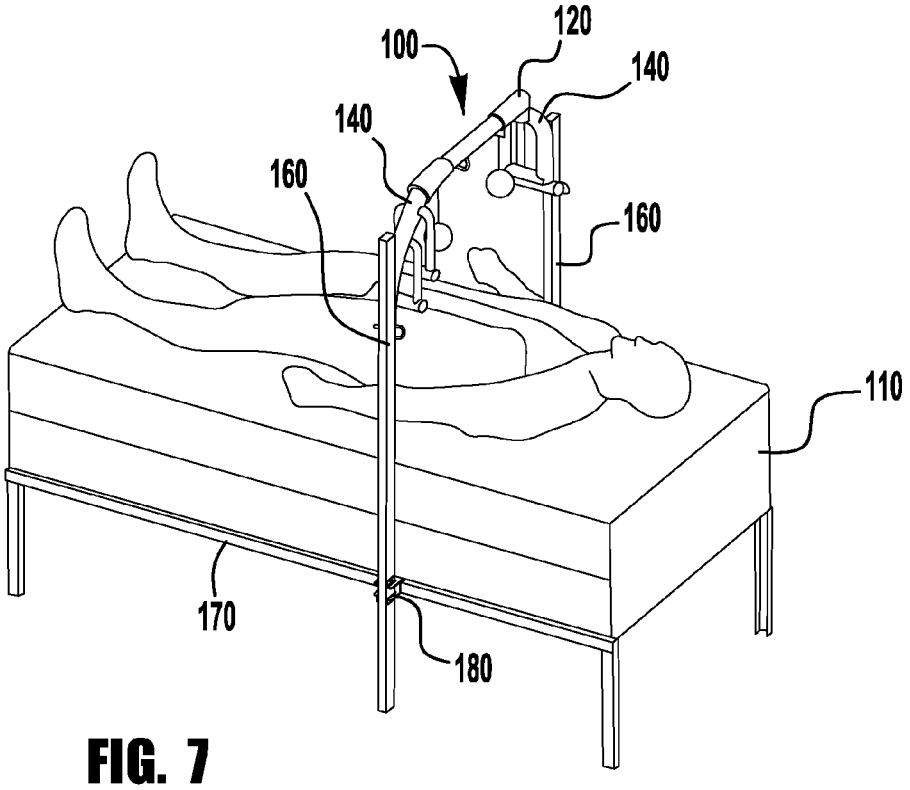
FIG. 7 is a front three dimensional view of an alternative embodiment of the bed exercise device in use on a traditional bed, in accordance with the present invention.

FIG. 7 illustrates a three-dimensional view of an alternative embodiment of the bed exercise device 100, in use with a bed 110. In general terms, bed exercise device 100 consists of a rail 120, arching portions 140, and first and second legs 160 designed to attach to the bed 110. The rail 120 is attached to arching portions 140 disposed on opposite ends of the rail, and the arching portions each contain a plurality of openings 130 extending there through. Each of the arching portions 140 is attached to a leg 160, which in turn are connected to the frame 170 of the bed 110. Each leg 160 has a first and second bracket 180 at each respective end 160*a*. Brackets 180 are utilized to attach to the frame 170 of the bed 110. Brackets 180 are designed to be easily moved on the legs 160 to accommodate frames 170 of different heights. In that case additional holes can be provided in the lower part of legs 160 so that the bracket can be bolted on in different locations on the legs. Further, brackets 180 are designed to be easily removed from the frame 170, to allow for easy disassembly and portability. The user may simply lay in the bed, and achieve fitness while recovering.

Exercises with the bed exercise device 100 may be performed from different positions, e.g., squatting, sitting, kneeling, and lying. The bed exercise device 100 may be used to exercise the whole body, e.g. upper, mid, and lower body parts including the arms, back, abdominals, and legs, to provide a total body workout. The bed exercise device 100 is simple to use and is universally capable of use by anyone.

Figure 8:
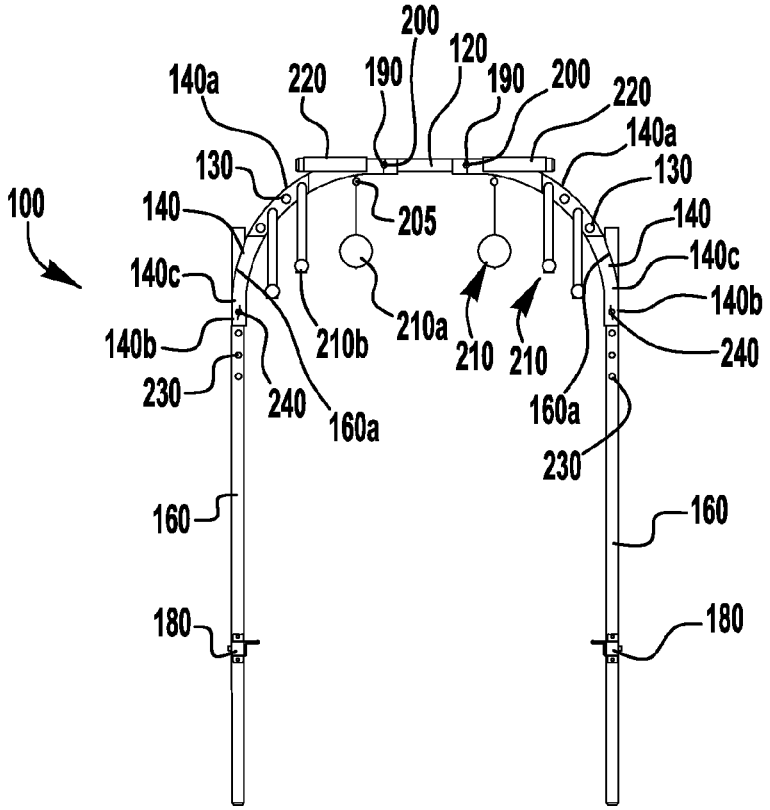
FIG. 8 is a front view of the alternative embodiment of the bed exercise device, in accordance with the present invention.

FIG. 8 illustrates a detailed view of the bed exercise device 100. The bed exercise device 100 may be constructed of any appropriate material, such as a plastic or lightweight metal. The bed exercise device 100 may be sized to accommodate a variety of standard bed sizes, such as a twin bed, full size, or queen sized bed. The dimensions of the bed exercise device 100 may include a length between the legs 160 with a range between 2 feet and 6 feet and a height from the bottom of the legs 160 to the top of rail 120 with a range between 2.5 feet and 8 feet.

The arching portions 140 are joined to the rail 120. Each arching portion 140 has an opening (not shown) that corresponds to an opening 190 in the rail 140. The rail 140 is designed to connect the two arching portions 140 with two quick release pins 200 that extend through the two openings 190 in the rail and through the corresponding openings in the arching portions. The quick release pins 200 are designed to disengage to allow the bed exercise device 100 to be quickly disassembled. Two rubber grip portions 220 may be secured to the rail 120 to allow for an easier grip on the bed exercise device 100.

There is a plurality of openings 130 within the upper sections 140*a* of each of the arching portions 140, through which a number of exercise components 210 are secured. There may be any number of openings 130. Each opening 130 has a diameter with a range between 0.0125 inches and 1 inch. There may be a variety of exercise components 210, such as an exercise ball 210*a*, or a handle 210*b* that may be suspended from these opening 130 if so desired. Further, arching portions 140 may contain loops 205, from which an exercise ball may 210*a* be hung by resistance bands if so desired. Alternatively, a resistance band (not shown) may be threaded through one of the openings 130, as illustrated in FIGS. 4 and 5.

The arching portions 140 are designed to connect to each of the two legs 160. Each arching portion 140 has an opening 140*b* in the lower section 140*c*, designed to correspond to an opening 230 in an upper portion 160*a* of each leg 160. A turn pin 240 can be inserted into the opening 140*b* and the corresponding opening 230 to join the arching portion 140 with the leg 160. There may be a plurality of openings 230 within the leg 160 to allow to arching portion 140 to be lowered and raised along the leg for a variety of heights for the exercise device 100.

Figure 8A:
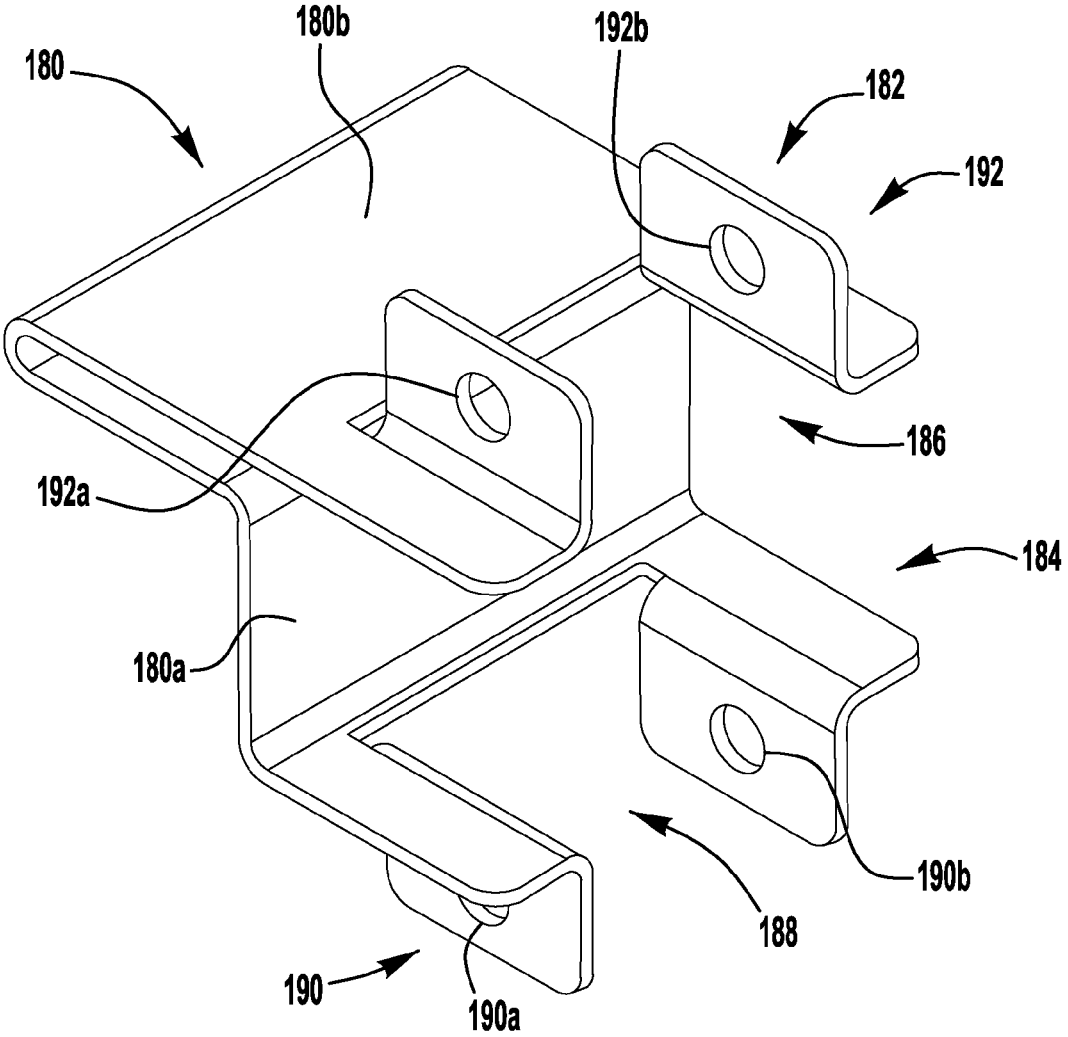

Attached to a lower portion of each leg 160 is a bracket 180 designed to mount upon the frame 170 of the bed 110, as seen in FIG. 7 and FIG. 8A. Each bracket 180 has a side portion 180*a* to rest against the side surface of a bed frame 170, a top portion 180*b* extending outward from the side portion and adapted to rest upon the upper surface of the bed frame. A pair of upper and lower mounting elements 182 and 184 are spaced from each other and have a rectangular opening 186 and 188, respectively, adapted to receive the leg therein. Each of the mounting elements 182 and 184 have a pair of upstanding tabs 190 and 192, respectively, adapted to receive the leg 160. A pair of holes 190*a* and 190*b* in tab 190 and a pair of holes 192*a* and 192*b* in tab 192 receive nuts and bolts to mount to the legs 160. The brackets 180 are designed to quickly and easily mount to the frame 170 with the side portions 180*a* resting against the side surface of the bed frame 170 and the top portions 180*b* resting on the upper surface of the bed frame.

FIGS. 9 and 10 illustrate an alternative embodiment of the bed exercise device 300, designed to provide a temporary and expedient manner of mounting the exercise device to a bed 310. The bed exercise device 300 is identical to the bed exercise device 100 embodiment described above, with the exception of the lower portion 320*a* of the first and second legs 320. There is a triangular frame 330 consisting of two support struts 340 that are each supported by base 350 and attach to the lower portion 320*a* of the legs 320. Although only one triangular frame 330 is shown, there will be a triangular frame on both legs 320 on each side of the bed 310. The triangular frame 330 can be held in place with brackets, such as for example, bracket 180 as described above and illustrated in FIG. 8*a*. At the bottom of base 350, wheels 351 can be provided so that the exercise device 300 can be easily moved from one location to another. However, it is also within the terms of the illustrated embodiment that the wheels 351 can be removed or not provided as required.

Figure 10A:
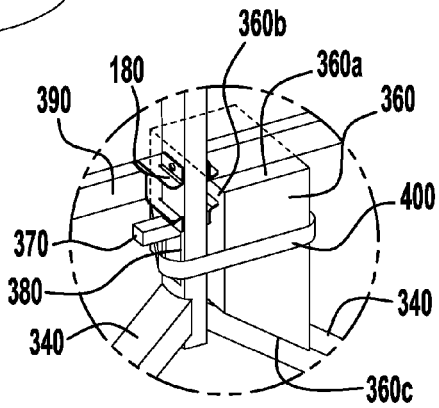

A wedge 360, preferably constructed of a plastic that is designed to slide along its bottom face 360*c* along the upper flat surface of either of the two support struts 340. There will be a wedge 360 on both sides of the bed. There is a peg 370 that extends from a front face 360*b* of the wedge 360. This peg 370 is preferably of a square shape, and is designed to fit into a slot 380 of the leg 320, as illustrated in FIGS. 10 and 10*a*. There is a top face 360*a* of the wedge 360 which fits flush against the bottom surface of frame 390 of the bed 310. Therefore, the wedge 360 must be wide enough to slide along the upper surface of support strut 340 and extend under the frame 390, as seen in FIG. 10*a*.

When engaging the wedge 360 to the bed 310 to mount the bed exercise device 300, the peg 370 is inserted into the slot 380 within the leg 320, thereby pressing the front face 360*b* against the leg, while the top face 360*a* engages firmly against the frame 390. Then, to keep the wedge 360 in place, a strap 400, such as a length of strap with Velcro fasteners at either end, is placed about the leg 320 and the wedge 360. With the wedges 360 on both legs 320 in place, an assembly of the rail, the first and second arching portions and the first and second legs of the bed exercise device 300 will be securely mounted to the bed frame 310. When the user desires to remove the bed exercise device 300, he may simply remove the strap 400, displace the peg 370 from the slot 380, and disengage the wedges 360 from both legs 320. Then the device 300 can be raised to disengage the brackets 180 from the bed frame 390.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An exercise device configured for attachment to a frame of a bed, comprising:

a rail;

first and second arching portions mounted on opposite ends of the rail, said first and second arching portions having a plurality of openings provided there through;

at least one exercise component mounted to one of the first and second arching portions at one of the plurality of openings;

first and second legs mounted to the first and second arching portions, respectively;

brackets attached to each of the first and second legs, respectively, for attaching the exercise device to the frame of the bed;

triangular frames attached to lower portions of each of the first and second legs, respectively, said triangular frames each including two support struts that extend from one of said lower portions of said first and second legs to opposite ends of a base, respectively, said triangular frames being configured to support an assembly that includes the rail, the first and second arching portions, and the first and second legs such that the rail extends above and laterally across the bed when the exercise device is attached to the frame of the bed; and a movable wedge disposed between one support strut of the two support struts and the frame of the bed, wherein the movable wedge has an upper flat surface adapted to engage an underside of the frame of the bed.

2. The bed exercise device of claim 1 wherein the first and second arching portions are adjustably mounted to the first and second legs to adjustably position the rail and the plurality of openings in the first and second arching portions with respect to the bed.

3. The bed exercise device of claim 1 wherein the movable wedge has a peg that extends from a front face of the wedge and is received in a slot provided in one of said first and second legs.

4. The bed exercise device of claim 3 wherein a strap is placed about said one of said first and second legs and the wedge to keep the upper flat surface of the wedge engaged with the underside of the bed frame.

5. The bed exercise device of claim 1 wherein the wedge has a width sufficient to simultaneously contact an upper surface of the support strut and extend under the frame of the bed.

* * * * *